US007682014B2

(12) United States Patent
Snyder et al.

(10) Patent No.: US 7,682,014 B2
(45) Date of Patent: Mar. 23, 2010

(54) APPARATUS FOR MEDIA PREHEATING IN AN INK JET PRINTER

(75) Inventors: Trevor James Snyder, Newberg, OR (US); James Edward Williams, Penfield, NY (US); Jeffrey J. Folkins, Rochester, NY (US); Barry Paul Mandel, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 566 days.

(21) Appl. No.: 11/351,759

(22) Filed: Feb. 10, 2006

(65) Prior Publication Data

US 2007/0188576 A1 Aug. 16, 2007

(51) Int. Cl.
*B41J 2/01* (2006.01)

(52) U.S. Cl. ..... 347/102; 219/216; 219/497; 219/619; 347/101; 347/103; 347/108; 347/213; 355/50; 355/400; 399/302; 399/405; 399/395

(58) Field of Classification Search ..... None
See application file for complete search history.

(56) References Cited

U.S. PATENT DOCUMENTS 5,614,933 A 3/1997 Hindman et al.
5,623,296 A * 4/1997 Fujino et al. ..... 347/103
5,927,189 A * 7/1999 Jones et al. ..... 101/23
5,940,669 A 8/1999 Bacus et al.
5,990,461 A 11/1999 Stumpf et al.
5,997,136 A * 12/1999 Fujisawa et al. ..... 347/101
6,309,114 B1 10/2001 Torisawa et al.
6,332,679 B1 * 12/2001 Higuma et al. ..... 347/102
6,396,528 B1 * 5/2002 Yanagawa ..... 347/213
6,495,811 B2 12/2002 Nitsche et al.
6,932,470 B2 8/2005 Pan et al.
6,963,723 B2 11/2005 Baba
7,229,167 B2 * 6/2007 Miyamoto et al. ..... 347/101
7,316,474 B2 * 1/2008 Tatsumi et al. ..... 347/101

* cited by examiner

*Primary Examiner*—Matthew Luu
*Assistant Examiner*—John P Zimmermann
(74) *Attorney, Agent, or Firm*—Maginot, Moore & Beck LLP

(57) ABSTRACT

An ink jet imaging system comprises a heated imaging drum that rotates in at least one direction, a print head for ejecting ink onto the heated imaging drum as it rotates past the print head to form an image, a media sheet transport for synchronizing movement of a media sheet with rotation of the heated imaging drum, a transfixing roller that forms a transfixing nip with the heated imaging drum to transfix the image on the rotating heated image drum onto the media sheet synchronized by the media sheet transport, and a media director located between the media sheet transport and the heated imaging drum to direct the media sheet into close proximity with the heated imaging drum at a position sufficiently prior to the transfixing nip that the heated imaging drum heats the media sheet before the media sheet enters the transfixing nip.

16 Claims, 2 Drawing Sheets

APPARATUS FOR MEDIA PREHEATING IN AN INK JET PRINTER

TECHNICAL FIELD

This disclosure relates generally to ink jet printers that generate images on media sheets, and, more particularly, to the components for heating media sheets before transferring the images to media sheets in such printers.

BACKGROUND

Ink jet printing systems using an intermediate imaging member are well known, such as that described in U.S. Pat. No. 5,614,922. Generally, the printing or imaging member is employed in combination with a print head to generate an image with ink. The ink is typically applied or emitted onto a final receiving surface or print medium by the nozzles of the print head. The image is then transferred and fixed to a final receiving surface. In two stage offset printing, the image is first transferred to the final receiving surface and then transfixed to the surface at a separate station. In other ink jet printing systems, the print head ejects ink directly onto a receiving surface and then the image is fixed to that surface.

More specifically, a solid ink jet or phase-change ink imaging process includes loading a solid ink stick or pellet into a feed channel. The ink stick or pellet is transported down the feed channel to a melt plate where the solid ink is melted. The melted ink drips into a heated reservoir where it is maintained in a liquid state. This highly engineered ink is formulated to meet a number of constraints, including low viscosity at jetting temperatures, specific visco-elastic properties at component-to-media transfer temperatures, and high durability at room temperatures. Once within the print head, the liquid ink flows through manifolds to be ejected from microscopic orifices through use of piezoelectric transducer (PZT) print head technology. The duration and amplitude of the electrical pulse applied to the PZT is very accurately controlled so that a repeatable and precise pressure pulse may be applied to the ink, resulting in the proper volume, velocity and trajectory of the droplet. Several rows of jets, for example, four rows, can be used, each one with a different color. The individual droplets of ink are jetted onto a thin liquid layer, such as silicone oil, for example, on the imaging member. The imaging member and liquid layer are held at a specified temperature such that the ink hardens to a ductile visco-elastic state.

After the ink is deposited onto the imaging member to form the image, a sheet of print medium is removed from a media supply and fed to a preheater in the sheet feed path. After the sheet is heated, it moves into a nip formed between the imaging member and a transfer member, either or both of which can also be heated. A high durometer transfer member is placed against the imaging member in order to develop a high-pressure nip. As the imaging member rotates, the heated print medium is pulled through the nip and pressed against the deposited ink image, thereby transferring the ink to the print medium. The transfer member compresses the print medium and ink together, spreads the ink droplets, and fuses the ink droplets to the print medium. Heat from the preheated print medium heats the ink in the nip, making the ink sufficiently soft and tacky to adhere to the print medium. When the print medium leaves the nip, stripper fingers or other like members, peel it from the imaging member and direct it into a media exit path.

To optimize image resolution, the transferred ink drops should spread out to cover a predetermined area, but not so much that image resolution is compromised or lost. Additionally, the ink drops should not melt during the transfer process. To optimize printed image durability, the ink drops should be pressed into the paper with sufficient pressure to prevent their inadvertent removal by abrasion. Finally, image transfer conditions should be such that nearly all the ink drops are transferred from the imaging member to the print medium. Therefore, efficient transfer of the image from the imaging member to the media is highly desirable.

Efficient transfer of ink or toner from an intermediate imaging member to a media sheet is enhanced by heating a media sheet before it is fed into the nip for transfer of the image. This assistance, however, comes with a substantial cost. For one, media preheaters are relatively expensive components. For another, the preheaters add weight to the printer and consume space within the interior of the printer. Accommodating the preheater in the arrangement of components for generating and transferring the image can be a complex design task. Moreover, the range of temperatures that may be produced by a preheater is restricted by the properties of the ink. If the temperature generated by the preheater is too great, the ink may smudge, especially during transfer of a duplex image.

SUMMARY

An ink jet imaging system comprises a heated imaging drum that rotates in at least one direction, a print head for ejecting ink onto the heated imaging drum as it rotates past the print head to form an image, a media sheet transport for synchronizing movement of a media sheet with rotation of the heated imaging drum, a transfixing roller that forms a transfixing nip with the heated imaging drum to transfix the image on the rotating heated image drum onto the media sheet synchronized by the media sheet transport, and a media director located between the media sheet transport and the heated imaging drum to direct the media sheet into close proximity with the heated imaging drum at a position sufficiently prior to the transfixing nip that the heated imaging drum heats the media sheet to a temperature for receiving the ink before the media sheet enters the transfixing nip. By incorporating a media director to move a media sheet into proximity with the heated imaging drum sooner, the imaging system is able to use the thermal mass of the imaging drum to heat media sheets rather than a media sheet preheater. Consequently, the imaging system is simpler in design, consumes less electrical energy, and does not require the expense of a media preheater.

DETAILED DESCRIPTION

Figure 1:
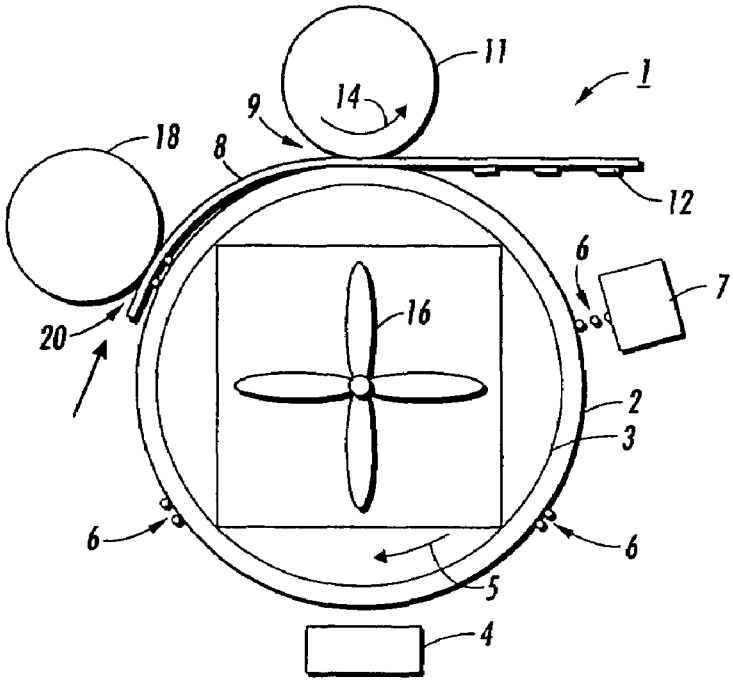
FIG. 1 is a schematic diagram of imaging components in a solid ink jet printer with a media sheet heated by the imaging drum.

Referring to FIG. 1, offset printing apparatus 1 is demonstrated to show transfer of an ink image from the imaging member to a final printing medium or receiving substrate that has been heated by the imaging member. As the imaging member 3 turns in the direction of arrow 5, a liquid surface 2 is deposited on imaging member 3 by applicator 4. The imaging member 3 is depicted in this embodiment as a drum member; however, other embodiments may be used, such as a belt member, film member, sheet member, or the like. The applicator 4 may be positioned at any position around the periphery of the imaging member 3, as long as the applicator 4 has the ability to make contact and apply liquid surface 2 to imaging member 3.

The ink used in the printing process may be a phase change ink, such as, for example, a solid ink. The term "phase change ink" means that the ink can change phases, such as a solid ink becoming liquid ink or changing from solid into a more malleable state. Specifically, in embodiments, the ink can be in solid form initially, and then can be changed to a molten state by the application of heat energy. The solid ink may be solid at room temperature, or at about 25° C. The solid ink may possess the ability to melt at relatively high temperatures above from about 85° C. to about 150° C. The ink is melted at a high temperature and then the melted ink 6 is ejected from print head 7 onto the liquid layer 2 of imaging member 3. The ink is then cooled to an intermediate temperature of from about 20° C. to about 80° C., or about 72° C., and solidifies into a malleable state in which it can then be transferred onto a final receiving substrate 8 or print medium 8.

To help maintain the ink on the imaging member 3 at the desired temperature, the imaging member 3 is heated. The heater 16 for the imaging member 3 may be located internally within the imaging member or it may be located externally along the periphery of the imaging member. The heater 16 may be a cartridge type heater, a radiant lamp heater, or other known roller heater. The imaging member 3 may be formed from or coated with any appropriate material, such as metals including, but not limited to, aluminum or nickel, elastomers including, but not limited to, fluoroelastomers, perfluoroelastomers, silicone rubber, and polybutiadiene, plastics including, but limited to, polyphenylene sulfide loaded with polytetrafluorethylene, thermoplastics such as acetals, polyethylene, nylon, and FEP, thermosets and ceramics. A commonly used material for imaging members in solid ink jet printers is anodized aluminum.

Some of the liquid layer 2 is transferred to the print medium 8 along with the ink. A typical thickness of transferred liquid is about 100 angstroms to about 100 nanometer, or from about 0.1 to about 200 milligrams, or from about 0.5 to about 50 milligrams, or from about 1 to about 10 milligrams per print medium. Suitable liquids that may be used as the print liquid surface 2 include water, fluorinated oils, glycol, surfactants, mineral oil, silicone oil, functional oils, and the like, and mixtures thereof. Functional liquids include silicone oils or polydimethylsiloxane oils having mercapto, fluoro, hydride, hydroxy, and the like functionality.

In previously known ink jet imaging systems, feed guides are generally aligned with the tangent to the imaging member 3 located at the nip 9 formed between the imaging member 3 and the pressure roller 11. These feed guides help to feed the print medium 8, such as paper, transparency or the like, into the nip 9. Additionally one or more of the feed guides in these previously known imaging systems incorporate a heating element to heat the medium to a temperature that facilitated the transfixing of the image to the medium. In the apparatus shown in FIG. 1, a media director 18 has been included to receive a media sheet from a media sheet transport (not shown) and direct the sheet into close proximity with the imaging member 3. The media sheet transport synchronizes movement of a media sheet with an image as it rotates with the heated imaging drum. The path length between the nip 20 and the nip 9 defines a heating zone for a media sheet.

When the print medium 8 is passed between the printing medium 3 and the pressure member 11, the ink 6, which is in a malleable state, is transferred from the imaging member 3 onto the print medium 8 in the image configuration. The final ink image 12 is spread, flattened, adhered, and fused or fixed to the final print medium 8 as the print medium moves through the nip 9. Stripper fingers (not shown) may be used to assist in removing the print medium 8 having the ink image 12 formed thereon to a final receiving tray (also not shown).

The pressure exerted at the nip 9 is from about 10 to about 1,000 psi., or about 500 psi, or from about 200 to about 500 psi. This is approximately twice the ink yield strength of about 250 psi at 50° C. In embodiments, higher temperatures, such as from about 72 to about 75° C. can be used, and at the higher temperatures, the ink is softer. Once the ink is transferred to the final print medium 8, it is cooled to an ambient temperature of from about 20° C. to about 250° C.

The media director 18 directs the print medium 8 into close proximity with the imaging member 3. By bringing the print medium into close proximity with a heated imaging member sooner than previously done in other systems, the thermal mass of the imaging member may be used to heat the print medium. As the imaging member is typically maintained at a temperature in a range of about 50 degrees Celsius to about 90 degrees Celsius, the placement of the media director 18 is selected so the length of the heating zone enables the heated imaging member to bring the print medium to a temperature that facilitates the print medium receiving the imaging material, such as ink or the like. In alternative embodiments, the heated member that heats the print medium to an appropriate temperature for transfer, transfixing, or fusing may be a heated fuser or a heated transfix roller. That is, a media director may be placed within a two stage offset set imaging system or a direct to print medium system in a manner similar to that described with respect to the offset process shown in FIG. 1. In any of these embodiments, a media preheater is not required to bring a print medium to an appropriate temperature for receiving the imaging material. Receiving imaging material may refer to transferring, transfixing, or fusing imaging material to the print medium. A media preheater is not required in the embodiments having a media director because the thermal mass of a heated member, such as an imaging drum, fuser roller, transfer roller, or transfixing roller is used to heat the print medium instead. Thus, the cost of a media preheater is avoided and an electrical component that dissipates energy is replaced with a mechanical structure that does not require the input of energy to perform its function.

In some ink jet printers, the media director may be used with a media preheater. In these embodiments, the media director is located between the output of the media preheater and the heated member. Although such embodiments incur the cost and energy consumption of a media preheater, they are able to process media sheets more quickly because the dwell time within the media preheater does not need to be long enough to cause a media sheet to reach the appropriate temperature for receiving imaging material. Instead, the media preheater is only required to elevate the temperature of the media sheet and the media director then enables the heated member to finish the heating of the sheet to the appropriate temperature.

Figure 2:
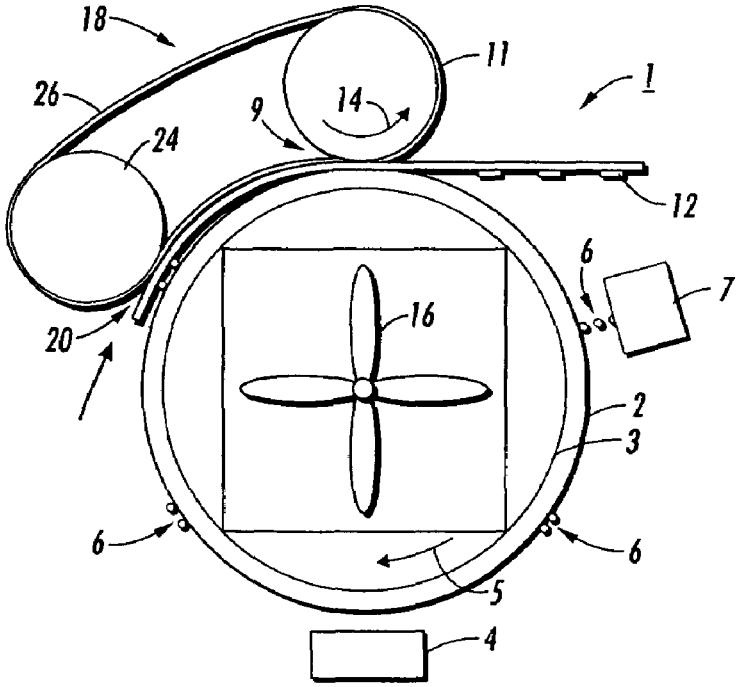
FIG. 2 is a schematic diagram of an alternative embodiment of the solid ink jet printer shown in FIG. 1.

An alternative embodiment of a media director in the printing apparatus of FIG. 1 is shown in FIG. 2. In this figure, the media director 18 is comprised of the pressure roller 11, media roller 24, and endless belt 26. The endless belt 26 is entrained about the pressure roller 11 and media roller 24. The roller 11 is placed to provide the pressure described above for the transfer of the ink image from the imaging member 3 to the print medium 8, accounting for the thickness of endless belt 26. The pressure provided at the nip 20 is sufficient to hold the print medium 8 in close proximity to the heated imaging member 3 so the thermal mass of the imaging member also heats the print medium 8.

Figure 3:
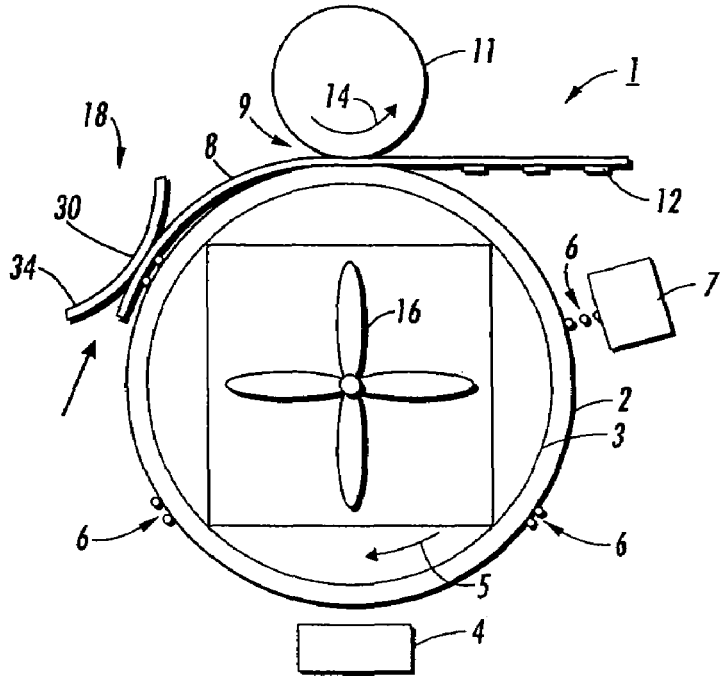
FIG. 3 is a schematic diagram of an alternative embodiment of the solid ink jet printer shown in FIG. 1.

Another alternative embodiment of a media director in the printing apparatus of FIG. 1 is shown in FIG. 3. In this figure, the media director 18 is comprised of a blade 30. The blade 30 includes a funneling end 34 that receives the leading edge of a print medium as it exits a print media transport and directs it into close proximity to the heated imaging member 3. The blade 30 may be formed from metal, such as aluminum, steel, or nickel, or alloys of such metals or the like. Alternatively, the blade 30 may be formed from thermoplastic materials. The blade 30 may be formed with a curvature that approximately parallels the periphery of the imaging member 3 to help hold print medium 8 in close proximity to the imaging member. The gap between the blade 30 and the imaging member 3 is appropriately sized to hold the thickest print medium processed by the apparatus shown in FIG. 3 in close proximity to the heated imaging member 3. Alternatively, the blade 30 may be mounted on a movable member so the gap between the blade 30 and the heated member may be adjusted to accommodate the thickness of the print medium being used for an image.

Figure 4:
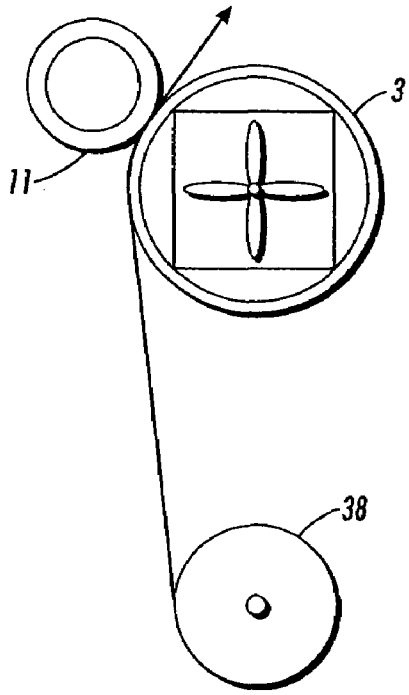
FIG. 4 is a schematic diagram of an embodiment of a solid ink jet printer that uses a continuous web supply of media that has been arranged to heat the media with the imaging drum prior to transfixing an image to the media.

Some ink jet printing devices may use a continuous web supply of print media. Such a device is shown in FIG. 4. The feed path of the continuous web, however, has been modified from previously known devices. Specifically, the web material supply roll 38 has been moved so that the web material is brought into close proximity of the heated member earlier in its feed path than in previously known systems. These previously known systems, instead, included a media preheater between the heated member and the web supply roll. Moving the supply roll 38 to the position shown in FIG. 4 reduces the need for a media preheater.

Those skilled in the art will recognize that numerous modifications can be made to the specific implementations described above. For example, numerous other configurations of the media director and its relationship to other printing process components can be constructed within the scope of the invention. Likewise, a media director may used in any ink jet printing system in which preheating of the media is useful for image transfer, transfixing, or fusing. Therefore, the following claims are not limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

We claim:

1. A media sheet heating mechanism in an imaging system comprising:

an imaging member that is heated to a temperature in the range of about 50 degrees Celsius to about 70 degrees Celsius, the imaging member carrying an ink image for transfer to a media sheet that passes through a nip formed with the imaging member; and a media director that is positioned relative to the imaging member to move a media sheet into contact with the heated imaging member at a position prior to the nip through which the media sheet passes for transfer of the ink image from the imaging member to enable the heated imaging member to heat the media sheet to a temperature that facilitates transfer of the ink image from the imaging member to the media sheet before media sheet enters the nip;

wherein the distance from the initial contact point of the media sheet with the media director to the nip formed with the imaging member is at least one fourth of the imaging member perimeter.

2. The mechanism of claim 1, the media director comprising:

a roller located upstream from the nip formed with the heated imaging member.

3. The mechanism of claim 1, the media director comprising:

an endless belt entrained about a set of rollers, the belt holding the media sheet in contact with the heated imaging member up to the nip formed with the heated imaging member.

4. The mechanism of claim 1, the media director comprising:

a mechanical diverter for urging the media sheet into contact with the heated imaging member as the sheet is moved by a media sheet transport and for holding the media sheet in contact with the heated imaging member before the sheet enters the nip formed with the heated member.

5. A media sheet heating mechanism in an ink jet imaging system comprising:

a heated imaging drum onto which ink is ejected to form an image on the heated imaging drum;

a transfixing roller that forms a transfixing nip with the heated imaging drum; and a media director positioned to move a media sheet having no ink thereon into contact with the heated imaging drum at a position prior to the transfixing nip to enable the heated imaging drum to heat the media sheet to a temperature that facilitates transfer of the ink from the imaging drum to the media sheet before the media sheet enters the transfixing nip;

wherein the distance from the initial contact point of the media sheet with the media director to the transfixing nip is at least one fourth of the circumference of the heated imaging drum.

6. The mechanism of claim 5, the media director comprising:

a media roller located proximate a periphery of the heated imaging drum; the media roller being positioned between a print head that ejects imaging material onto the imaging drum and the transfixing nip.

7. The mechanism of claim 5, the media director comprising:

an endless belt entrained about a set of rollers, the belt being proximate a periphery of the heated imaging drum to hold the media sheet in contact with the heated imaging drum from a position between a print head that ejects imaging material onto the imaging drum up to the transfixing nip.

8. The mechanism of claim 5, the media director comprising:

a blade for receiving a leading edge of the media sheet and directing the media sheet into contact with the heated imaging drum, the blade extending along a periphery of the imaging drum to a position near the transfixing nip to hold the media sheet in proximity to the heated imaging drum before the sheet enters the transfixing nip.

9. The mechanism of claim 8, the blade comprising:

a funneling end to receive the leading edge of the media sheet.

10. The mechanism of claim 5, wherein the media director holds the media sheet in proximity to the heated imaging drum for a distance that enables the media sheet to reach a temperature within a range of about 50 degrees Celsius to about 70 degrees Celsius.

11. An ink jet imaging system comprising:

a heated imaging drum that rotates in at least one direction;

a print head for ejecting ink onto the heated imaging drum as it rotates past the print head to form an image;

a media sheet transport for synchronizing movement of a media sheet with rotation of the heated imaging drum to enable the media sheet to be brought into proximity to the heated imaging drum for transfer of the ink image from the heated imaging drum to the media sheet;

a transfixing roller that forms a transfixing nip with the heated imaging drum to transfer the ink image on the rotating heated image drum onto the media sheet synchronized by the media sheet transport; and a media director located between the media sheet transport and the heated imaging drum to direct the media sheet into close proximity with the heated imaging drum at a position sufficiently prior to the transfixing nip that the heated imaging drum heats the media sheet to a temperature that facilitates transfer of the ink image from the heated imaging drum to the media sheet in the transfixing nip before the media sheet enters the transfixing nip;

wherein the distance from the initial contact point of the media sheet with the media director to the transfixing nip is at least one fourth of the circumference of the heated imaging drum.

12. The system of claim 11, the media director comprising:

a media roller located proximate a periphery of the heated imaging drum; the media roller being positioned between the print head that ejects ink onto the imaging drum and the transfixing nip.

13. The system of claim 11, the media director comprising:

an endless belt entrained about a set of rollers for rotation about the set of rollers, the belt being proximate a periphery of the heated imaging drum to move the media sheet in synchronization with the image on the heated imaging drum while keeping the media sheet in close proximity to the heated imaging drum from a position between the print head up to the transfixing nip.

14. The system of claim 11, the media director comprising:

a blade for receiving a leading edge of the media sheet as the leading edge exits the media sheet transport, the blade extending along a periphery of the imaging drum to a position near the transfixing nip to hold the media sheet in proximity to the heated imaging drum before the sheet enters the transfixing nip.

15. The system of claim 14, the blade comprising:

a funneling end to receive the leading edge of the media sheet as the leading edge exits the media sheet transport.

16. The system of claim 11, wherein the media director holds the media sheet in proximity to the heated imaging drum for a distance that enables the media sheet to reach a temperature within a range of about 50 degrees Celsius to about 70 degrees Celsius before the media sheet enters the transfixing nip.

* * * * *